US008931557B2

(12) United States Patent
Patterson et al.

(10) Patent No.: US 8,931,557 B2
(45) Date of Patent: Jan. 13, 2015

(54) WELLBORE SERVICING ASSEMBLIES AND METHODS OF USING THE SAME

(75) Inventors: Robert Brice Patterson, Duncan, OK (US); William Colt Ables, Duncan, OK (US); Jon Jacob Giles, Marlow, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 337 days.

(21) Appl. No.: 13/544,750

(22) Filed: Jul. 9, 2012

(65) Prior Publication Data

US 2014/0008071 A1 Jan. 9, 2014

(51) Int. Cl.
*E21B 43/26* (2006.01)
*E21B 43/114* (2006.01)

(52) U.S. Cl.
USPC ..... 166/308.1; 166/298; 166/331; 166/177.5

(58) Field of Classification Search
CPC ..... E21B 43/114; E21B 43/25; E21B 43/26; E21B 43/261; E21B 43/267; E21B 34/10; E21B 34/101
USPC ..... 166/308.1, 331, 298, 177.5, 147, 191
See application file for complete search history.

(56) References Cited

U.S. PATENT DOCUMENTS

| | | | | |
|---|---|---|---|---|
| 2,222,750 | A | 11/1940 | Litolff | |
| 5,335,724 | A | 8/1994 | Venditto et al. | |
| 5,396,953 | A | 3/1995 | Holder et al. | |
| 5,609,178 | A | 3/1997 | Hennig et al. | |
| 7,159,660 | B2 | 1/2007 | Justus | |
| 7,234,529 | B2 * | 6/2007 | Surjaatmadja | 166/374 |
| 7,681,654 | B1 * | 3/2010 | Cugnet | 166/387 |
| 7,849,924 | B2 * | 12/2010 | Surjaatmadja et al. | 166/298 |
| 8,104,539 | B2 * | 1/2012 | Stanojcic et al. | 166/308.1 |
| 2002/0162660 | A1 * | 11/2002 | Depiak et al. | 166/308 |
| 2007/0051521 | A1 * | 3/2007 | Fike et al. | 166/387 |

(Continued)

FOREIGN PATENT DOCUMENTS

| | | | |
|---|---|---|---|
| EP | 0427422 | A2 | 5/1991 |
| GB | 2391239 | A | 2/2004 |
| GB | 2398585 | A | 8/2004 |
| WO | 2008142409 | A1 | 11/2008 |
| WO | 2014011361 | A2 | 1/2014 |

OTHER PUBLICATIONS

Schlumberger Oilfield Glossary entires for "staged fracturing", "J-slot", "perforate", and "perforation", accessed Aug. 13, 2014 via www.glossary.oilfield.slb.com.*

(Continued)

*Primary Examiner* — Blake Michener

(57) ABSTRACT

An apparatus for servicing a wellbore comprising a housing, high-pressure ports, high-volume ports, and a mandrel slidably positioned within the housing. The housing defines an axial flowbore and the mandrel defines a mandrel axial flowbore. The mandrel is alternatingly movable from a first position to a second position and to a third position. When the mandrel is in the second position, a route of fluid communication via the high-pressure ports is provided and a route of fluid communication via the high-volume ports is obstructed. When the mandrel is in the third position, a route of fluid communication via the high-volume ports is provided. The apparatus is transitionable from the second position to the third position without communicating an obturating member to the apparatus, without removing an obturating member from the apparatus, or combinations thereof.

22 Claims, 7 Drawing Sheets

(56) References Cited

U.S. PATENT DOCUMENTS

| | | | | |
|---|---|---|---|---|
| 2007/0102156 | A1* | 5/2007 | Nguyen et al. | 166/280.2 |
| 2007/0284106 | A1* | 12/2007 | Kalman et al. | 166/298 |
| 2008/0210429 | A1* | 9/2008 | McMillin et al. | 166/313 |
| 2009/0159299 | A1 | 6/2009 | Kratochvil et al. | |
| 2010/0044041 | A1 | 2/2010 | Smith et al. | |
| 2010/0122817 | A1* | 5/2010 | Surjaatmadja et al. | 166/308.1 |
| 2011/0067870 | A1 | 3/2011 | East, Jr. | |
| 2012/0205108 | A1* | 8/2012 | Stang | 166/298 |
| 2013/0180721 | A1* | 7/2013 | Getzlaf et al. | 166/308.1 |
| 2013/0213655 | A1* | 8/2013 | Martinez | 166/298 |
| 2013/0299173 | A1* | 11/2013 | Stromquist et al. | 166/298 |
| 2014/0182849 | A1* | 7/2014 | Kumbhar et al. | 166/255.1 |

OTHER PUBLICATIONS

Foreign communication from a related counterpart application—International Search Report and Written Opinion, PCT/US2013/046127, Feb. 28, 2014, 12 pages.

Filing receipt and specification for patent application entitled "Wellbore Servicing Assemblies and Methods of Using the Same," by Koustubh Dnyaneshwar Kumbhar, et al., filed Dec. 28, 2012 as U.S. Appl. No. 13/729,181.

Foreign communication from a related counterpart application—International Search Report and Written Opinion, PCT/US2013/074737, Oct. 24, 2014, 10 pages.

* cited by examiner

WELLBORE SERVICING ASSEMBLIES AND METHODS OF USING THE SAME

CROSS-REFERENCE TO RELATED APPLICATIONS

Not applicable.

STATEMENT REGARDING FEDERALLY SPONSORED

Not applicable.

RESEARCH OR DEVELOPMENT

Not applicable.

REFERENCE TO A MICROFICHE APPENDIX

Not applicable.

BACKGROUND

Hydrocarbon-producing wells often are stimulated by hydraulic fracturing operations, wherein a servicing fluid such as a fracturing fluid or a perforating fluid may be introduced into a portion of a subterranean formation penetrated by a wellbore at a hydraulic pressure sufficient to create or enhance at least one fracture therein. Such a subterranean formation stimulation treatment may increase hydrocarbon production from the well.

In some wells, it may be desirable to individually and selectively create multiple fractures along a wellbore at a distance apart from each other, creating multiple "pay zones." The multiple fractures should have adequate conductivity, so that the greatest possible quantity of hydrocarbons in an oil and gas reservoir can be drained/produced into the wellbore.

As part of a formation stimulation process, one or more perforations may be introduced into a casing string, a cement sheath surround a casing string, the formation, or combinations thereof, for example, for the purpose of allowing fluid communication into the formation and/or a zone thereof. For example, such perforations may be introduced via fluid jetting operation where a fluid is introduced at a pressure suitable to form perforations in the casing string, cement sheath, and/or formation. In addition, a formation stimulation process might further involve a hydraulic fracturing operation in which one or more fractures are introduced into the formation via the previously formed perforations. Such a formation stimulation procedure may create and/or extend one or more flowpaths into the wellbore from the stimulated formation and thereby increase the movement of hydrocarbons from the fractured formation into the wellbore.

Such a stimulation operation either necessitates the placement and removal of wellbore servicing tools configured for each of the perforating and fracturing operations and/or reconfiguring a suitable wellbore servicing tool between a perforating configuration and a fracturing operation. However, many conventional servicing tools require that an obturating member (e.g., a ball, dart, etc.) be pumped down to the wellbore servicing tool from the surface (e.g., run-in) and/or reversed out of the wellbore (e.g., "run-out") in order to accomplish such reconfigurations. Either scenario results in a great deal of lost time and, thus, increased expense for the stimulation process. In addition, such conventional wellbore servicing tools are subject to wear and erosion, potentially resulting in the failure the wellbore servicing tool to transition between the perforating and fracturing configurations.

As such, there exists a need for an improved downhole wellbore servicing tool.

SUMMARY

Disclosed herein is an apparatus for servicing a wellbore comprising a housing defining an axial flowbore extending therethrough and comprising one or more high-pressure ports, and one of more high-volume ports, and a mandrel slidably positioned within the housing, the mandrel defining a mandrel axial flowbore and being alternatingly movable from a first position relative to the housing to a second position relative to the housing and to a third position relative to the housing, wherein, when the mandrel is in the second position, a route of fluid communication via the one or more high-pressure ports is provided and a route of fluid communication via the high-volume ports is obstructed, wherein, when the mandrel is in the third, position, a route of fluid communication via the high-volume ports is provided, and wherein the apparatus is transitionable from the second position to the third position without communicating an obturating member to the apparatus, without removing an obturating member from the apparatus, or combinations thereof.

Also disclosed herein is a system for servicing a wellbore comprising a tubular disposed within the wellbore, a wellbore servicing apparatus coupled to a downhole end of the tubular, the wellbore servicing apparatus being transitionable between a jetting configuration and a fracturing configuration, wherein the wellbore servicing apparatus is configured to cycle between the jetting configuration and the fracturing configuration without communicating an obturating member to the wellbore servicing apparatus, without removing an obturating member from the wellbore servicing apparatus, or combinations thereof.

Further disclosed herein is a method for servicing a wellbore comprising positioning a wellbore servicing apparatus within the wellbore proximate to a first subterranean formation zone, configuring the wellbore servicing apparatus to deliver a jetting fluid without communicating an obturating member to the wellbore servicing apparatus, without removing an obturating member from the wellbore servicing apparatus, or combinations thereof, communicating the jetting fluid via the wellbore servicing apparatus, configuring the wellbore servicing apparatus to deliver a fluid at a rate and pressure sufficient to form and/or extend a fracture within the first subterranean formation zone without communicating an obturating member to the wellbore servicing apparatus, without removing an obturating member from the wellbore servicing apparatus, or combinations thereof, forming a fracture within the first subterranean formation zone by communicating a fluid via the wellbore servicing apparatus.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
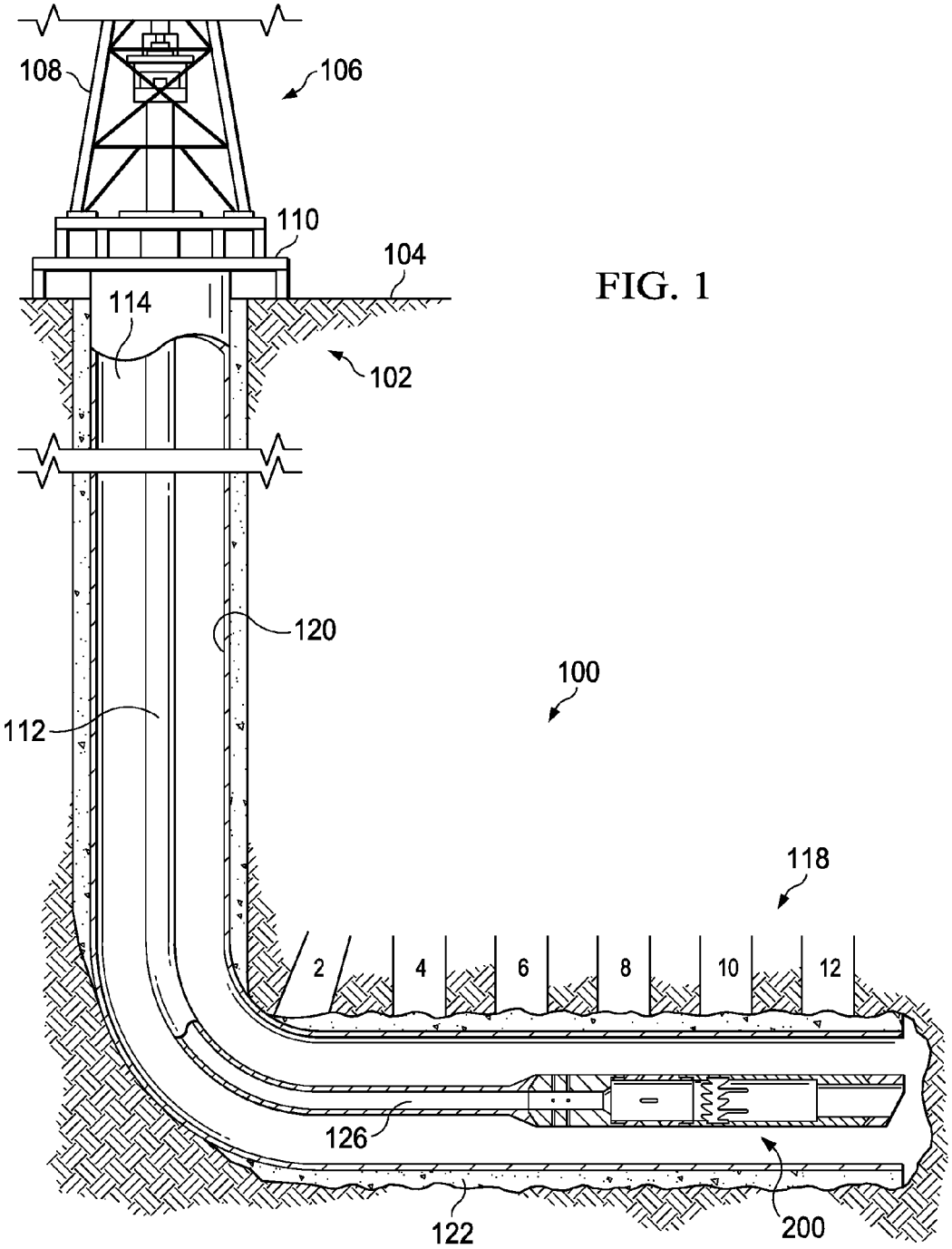
FIG. 1 is a simplified cutaway view of a wellbore servicing apparatus in an operating environment.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally from the formation toward the surface or toward the surface of a body of water; likewise, use of "down," "lower," "downward," "down-hole," "downstream," or other like terms shall be construed as generally into the formation away from the surface or away from the surface of a body of water, regardless of the wellbore orientation. Use of any one or more of the foregoing terms shall not be construed as denoting positions along a perfectly vertical axis.

Unless otherwise specified, use of the term "subterranean formation" shall be construed as encompassing both areas below exposed earth and areas below earth covered by water such as ocean or fresh water.

Disclosed herein are embodiments of wellbore servicing apparatuses, systems, and methods of using the same. Particularly, disclosed herein are one or more embodiments of a wellbore servicing system comprising a wellbore servicing apparatus, as will be disclosed herein, configured to be selectively transitioned between a configuration suitable for the performance a perforating operation and a configuration suitable for the performance of a fracturing operation.

Referring to FIG. 1, an embodiment of an operating environment in which such a wellbore servicing apparatus and/or system may be employed is illustrated. It is noted that although some of the figures may exemplify horizontal or vertical wellbores, the principles of the apparatuses, systems, and methods disclosed may be similarly applicable to horizontal wellbore configurations, conventional vertical wellbore configurations, and combinations thereof. Therefore, the horizontal or vertical nature of any figure is not to be construed as limiting the wellbore to any particular configuration.

As depicted in FIG. 1, the operating environment generally comprises a wellbore 114 that penetrates a subterranean formation 102 comprising a plurality of formation zones 2, 4, 6, 8, and 12 for the purpose of recovering hydrocarbons, storing hydrocarbons, disposing of carbon dioxide, or the like. Wellbore 114 may be drilled into the subterranean formation 102 using any suitable drilling technique. In an embodiment, a drilling or servicing rig 106 disposed at the surface 104 comprises a derrick 108 with a rig floor 110 through which a work string (e.g., a drill string, a tool string, a segmented tubing string, a jointed tubing string, or any other suitable conveyance, or combinations thereof) generally defining an axial flowbore 126 may be positioned within or partially within wellbore 114. In an embodiment, such a work string may comprise two or more concentrically positioned strings of pipe or tubing (e.g., a first work string may be positioned within a second work string). The drilling or servicing rig may be conventional and may comprise a motor driven winch and other associated equipment for lowering the work string into wellbore 114. Alternatively, a mobile workover rig, a wellbore servicing unit (e.g., coiled tubing units), or the like may be used to lower the work string into the wellbore 114. In such an embodiment, the work string may be utilized in drilling, stimulating, completing, or otherwise servicing the wellbore, or combinations thereof.

Wellbore 114 may extend substantially vertically away from the earth's surface over a vertical wellbore portion, or may deviate at any angle from the earth's surface 104 over a deviated or horizontal wellbore portion 118. In alternative operating environments, portions or substantially all of wellbore 114 may be vertical, deviated, horizontal, and/or curved and such wellbore may be cased, uncased, or combinations thereof. In some instances, at least a portion of the wellbore 114 may be lined with a casing 120 that is secured into position against the formation 102 in a conventional manner using cement 122. In this embodiment, deviated wellbore portion 118 includes casing 120. However, in alternative operating environments, the wellbore 114 may be partially cased and cemented thereby resulting in a portion of the wellbore 114 being uncased. In an embodiment, a portion of wellbore 114 may remain uncemented, but may employ one or more packers (e.g., Swellpackers™, commercially available from Halliburton Energy Services, Inc.) to isolate two or more adjacent portions or zones within wellbore 114.

Referring to FIG. 1, a wellbore servicing system 100 is illustrated. In the embodiment of FIG. 1, wellbore servicing system 100 comprises a wellbore servicing tool 200 incorporated within work string 112 and positioned proximate and/or substantially adjacent to one of a plurality of subterranean formation zones (or "pay zones") 2, 4, 6, 8, 10 or 12. Additionally, although the embodiment of FIG. 1 illustrates wellbore servicing system 100 incorporated within work string 112, a similar wellbore servicing system may be similarly incorporated within any other suitable work string (e.g., a drill string, a tool string, a segmented tubing string, a jointed tubing string, a coiled-tubing string, or any other suitable conveyance, or combinations thereof), as may be appropriate for a given servicing operation. Additionally, while in the embodiment of FIG. 1, the wellbore servicing tool 200 is located and/or positioned substantially adjacent to a single zone (e.g., zone 12), a given single servicing tool 200 may be positioned adjacent to two or more zones.

In one or more of the embodiments disclosed herein, wellbore servicing tool 200 may be configured to be actuated while disposed within a wellbore like wellbore 114. In an embodiment, servicing tool 200 may be configured to alternatingly cycle between a "first" configuration and a "second" configuration and between the first configuration and a "third" configuration. For example, in an embodiment such a wellbore servicing apparatus may be transitioned from the first configuration to the second configuration, from the second configuration back to the first configuration and, then, from the first configuration to the third configuration, as will be disclosed herein. Additionally, in an embodiment, such a wellbore servicing apparatus may be transitioned from the third configuration back to the first configuration and, then, the cycle repeated again, as will also be disclosed herein.

Figure 5:
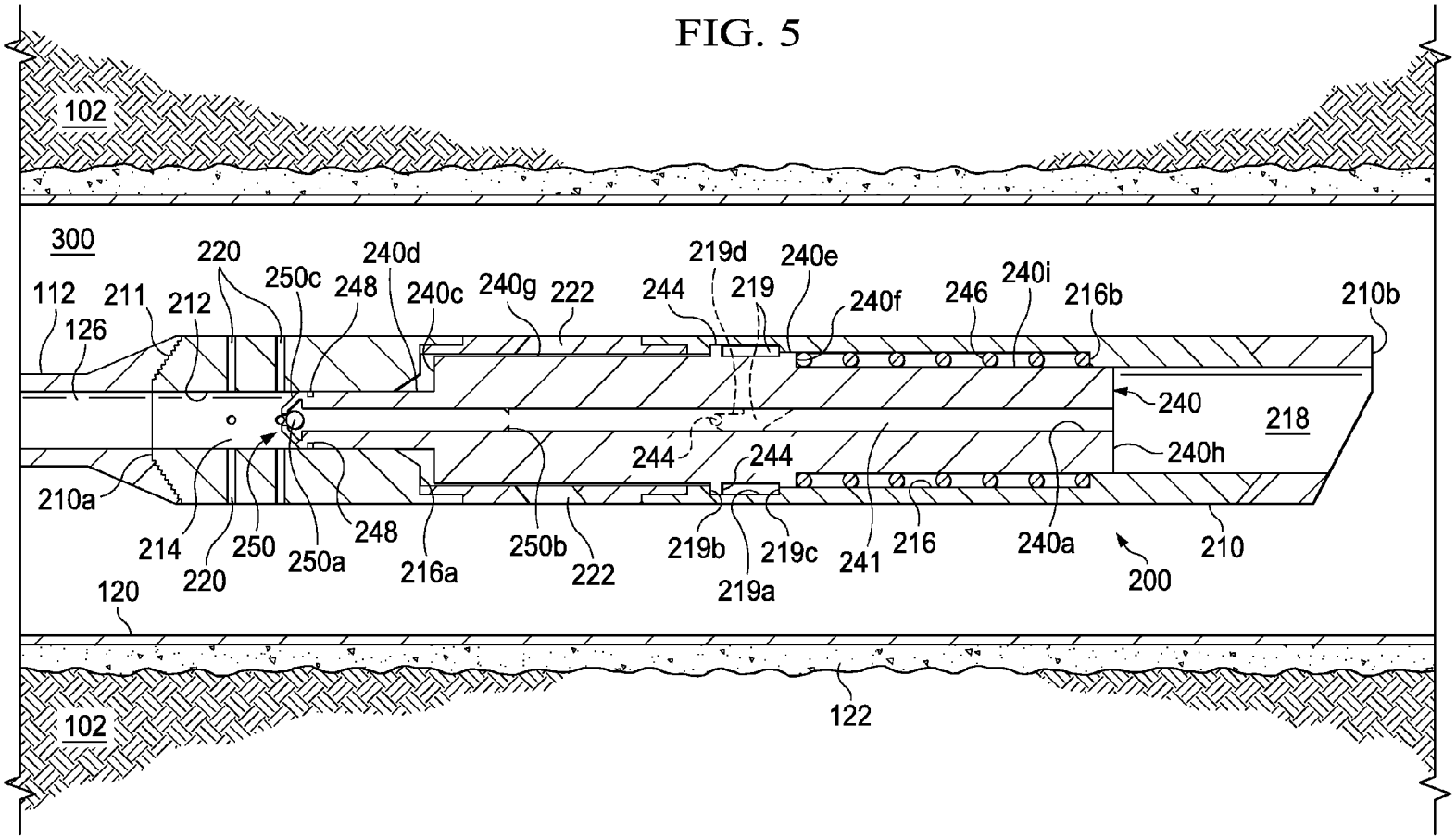
FIG. 5 is a cross-sectional view of an embodiment of the wellbore servicing tool of FIG. 2 in an unset mode.

Referring to FIG. 5, an embodiment of a wellbore servicing tool 200 is illustrated in the first configuration, particularly, in an unset mode. In an embodiment, when servicing tool 200 is in the first configuration, the tool 200 may be transitionable to the second configuration or to the third configuration, as will be disclosed herein. Additionally, in an embodiment, when the servicing tool 200 is in the unset mode of the first configuration, servicing tool 200 is configured to obstruct a route of fluid communication, particularly, a downward route of fluid communication, through an axial flowbore 214 of servicing tool 200.

Figure 6:
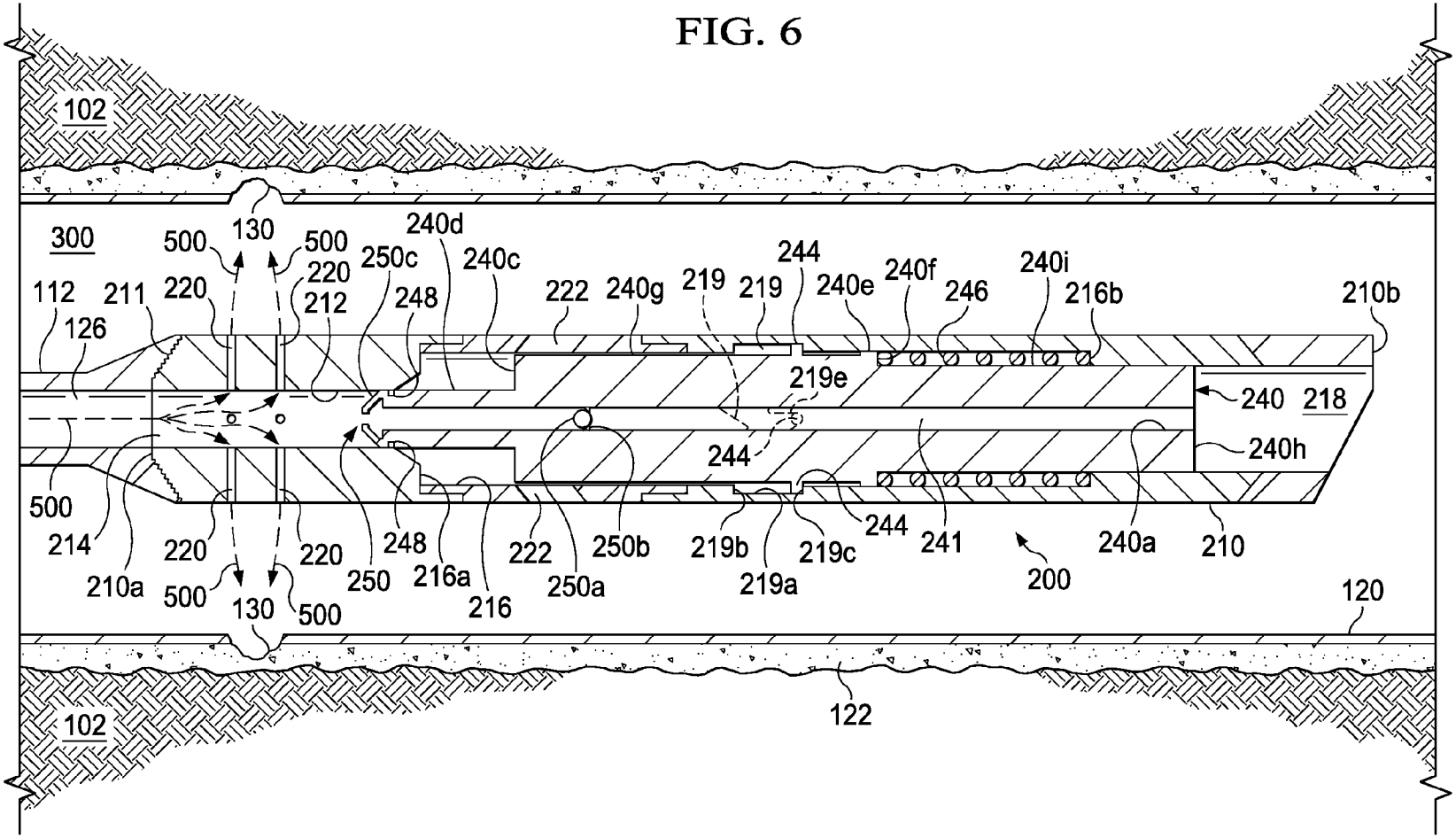
FIG. 6 is a cross-sectional view of an embodiment of the wellbore servicing tool of FIG. 2 in a jetting mode.

Referring to FIG. 6, an embodiment of the wellbore servicing tool 200 is illustrated in the second configuration, also referred to as a "jetting" configuration. In an embodiment, when the servicing tool 200 is in the second configuration, the tool 200 is configured to provide a route of fluid communication from axial flowbore 126 of work string 112, through one or more relatively high pressure ports (e.g., ports 220 of servicing tool 200), for example, as may be suitable for the communication of a hydrajetting and/or perforating fluid. Further, when the servicing tool 200 is in the second configuration, the servicing tool may be transitionable to the first configuration.

Figure 7:
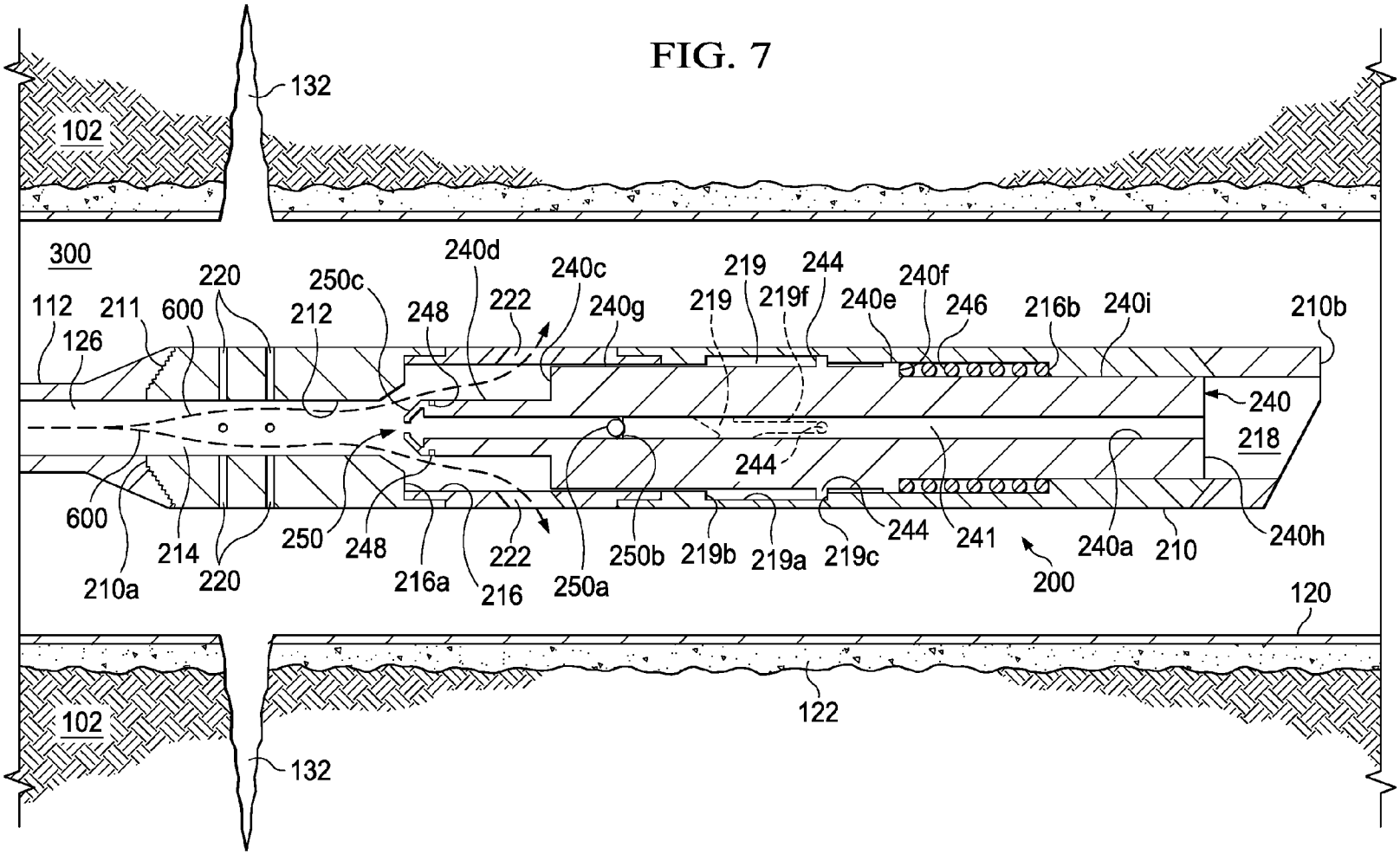
FIG. 7 is a cross-sectional view of an embodiment of the wellbore servicing tool of FIG. 2 in a mixing or fracturing mode.

Referring to FIG. 7, an embodiment of the wellbore servicing tool 200 is illustrated in the third configuration, also referred to as a "fracturing" or "mixing" configuration. In an embodiment, when servicing tool 200 is in the third configuration, the tool 200 is configured to provide a route of fluid communication from flowbore 126 of work string 112, through one or more relatively high volume openings (e.g., openings 222 of servicing tool 200), for example as may be suitable for the communication of a fracturing fluid. Further, when the servicing tool 200 is in the third configuration, the servicing tool may be transitionable to the first configuration.

Figure 8:
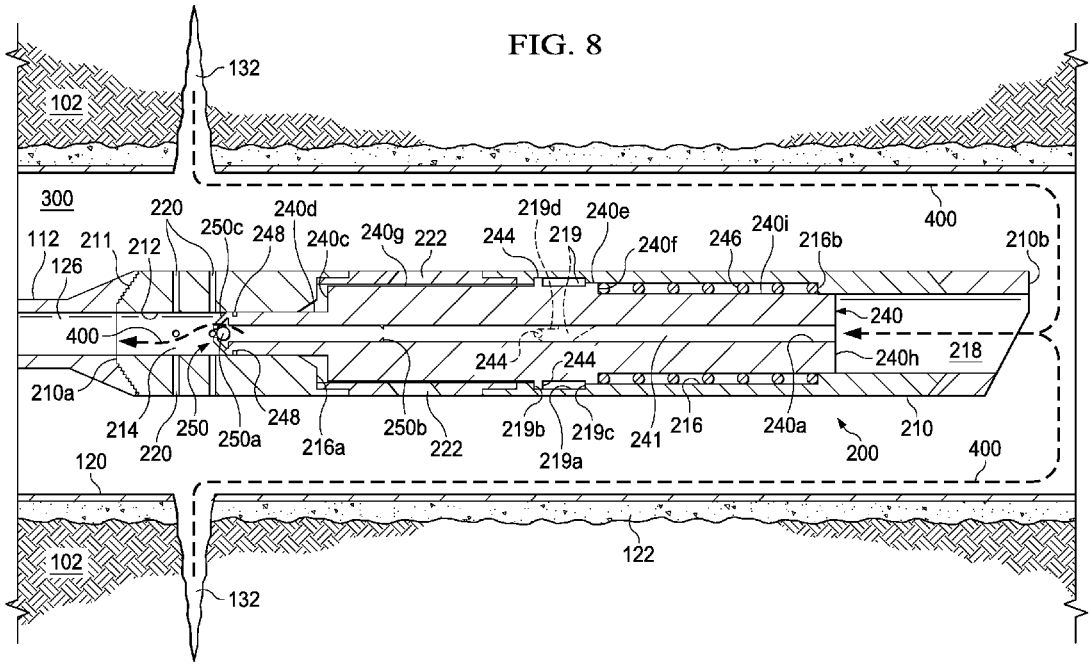
FIG. 8 is a cross-sectional view of an embodiment of the wellbore servicing tool of FIG. 2 in a recirculation mode.

Referring to FIG. 8, an embodiment of the wellbore servicing tool 200 is illustrated in the first configuration, particularly, in a recirculation mode. In an embodiment, when the servicing tool 200 is in the recirculation mode of the first configuration, servicing tool 200 is configured to provide a route of fluid communication, particularly, an upward route of fluid communication, from an exterior of the tool 200, through an axial flowbore 214 of servicing tool 200, to the flowbore 126 of work string 112. Further, the servicing tool 200 may be transitioned between the unset mode and the recirculation mode of the first configuration as will be disclosed herein.

Referring to the embodiments of FIGS. 2-7, wellbore servicing tool 200 generally comprises a housing 210 and a tubular member or mandrel 240. Also, the servicing tool 200 may be characterized with respect to a central or longitudinal axis 205.

In an embodiment, housing 210 may be characterized as a generally tubular body having a first terminal end 210*a* (e.g., an uphole end) and a second terminal end 210*b* (e.g., a downhole end). Housing 210 may also be characterized as generally defining a longitudinal, axial flowbore 214. In an embodiment, housing 210 may be configured for connection to and/or incorporation within a string, such as work string 112. For example, housing 210 may comprise a suitable means of connection to work string 112. For instance, in the embodiments illustrated in FIGS. 4-8, terminal end 210*a* of housing 210 may comprise one or more internally and/or externally threaded surfaces 211 as may be suitably employed in making a threaded connection to work string 112. Alternatively, a wellbore servicing tool like servicing tool 200 may be incorporated within a work string like work string 112 by any suitable connection, such as, for example, via one or more quick-connector type connections. Suitable connections to a work string member will be known to those of skill in the art viewing this disclosure. The axial flowbore 214 may be in fluid communication with the axial flowbore 126 defined by work string 112. For example, a fluid communicated via the axial flowbore 126 of work string 112 will flow into and through axial flowbore 214 of servicing tool 200.

In an embodiment, housing 210 comprises one or more relatively high-pressure ports 220 (e.g., suitable for a perforating or fluid jetting operation) configured to communicate a fluid from the axial flowbore 214 of housing 210 to a proximate subterranean formation zone when the wellbore servicing tool 200 is so configured. In an embodiment, ports 220 may be fitted with one or more pressure-altering devices (e.g., nozzles, erodible nozzles, jets, or the like). In an additional embodiment, ports 220 may be fitted with plugs, screens, covers, or shields, for example, to prevent debris from entering ports 220.

In an embodiment, housing 210 may also comprise one or more bores or relatively high-volume openings 222 (e.g., suitable for a fluid fracturing operation and suitable for higher volume fluid flow relative to ports 220) configured to communicate a fluid from the axial flowbore 214 to a proximate subterranean formation zone when the servicing tool 200 is so configured. For example, in the embodiment of FIGS. 5 and 6 (e.g., where servicing tool 200 is in the first mode and where the servicing tool 200 is in the second, jetting configuration), openings 222 within housing 210 are obstructed by mandrel 240, as will be discussed herein, and will not communicate fluid from axial flowbore 214 to an exterior of the housing 210 and/or the surrounding formation 102. In the embodiment of FIG. 7 (e.g., where servicing tool 200 is in the third, fracturing configuration), openings 222 within housing 210 are unobstructed, as will be discussed herein, and may communicate fluid from axial flowbore 214 to the exterior of the housing 210 and/or the surrounding formation 102. In an embodiment, openings 222 may be characterized as comprising a relatively larger cross-sectional area (for example, for the communication of a fluid) than ports 220, for example, such that openings 222 provide for a lesser restriction of fluid flow than ports 220. In an embodiment, opening 222 have a total surface area (e.g., area of the opening) at least 50%, 100%, 150%, 200%, 250%, 300%, 350%, 400%, 450%, or 500% greater than ports 220.

In an embodiment, housing 210 may comprise a unitary structure (e.g., a single unit of manufacture, such as a continuous length of pipe or tubing); alternatively, housing 210 may comprise two or more operably connected components (e.g., two or more coupled sub-components, such as by a threaded connection). Alternatively, a housing like housing 210 may comprise any suitable structure; such suitable structures will be appreciated by those of skill in the art upon viewing this disclosure.

Figure 3:
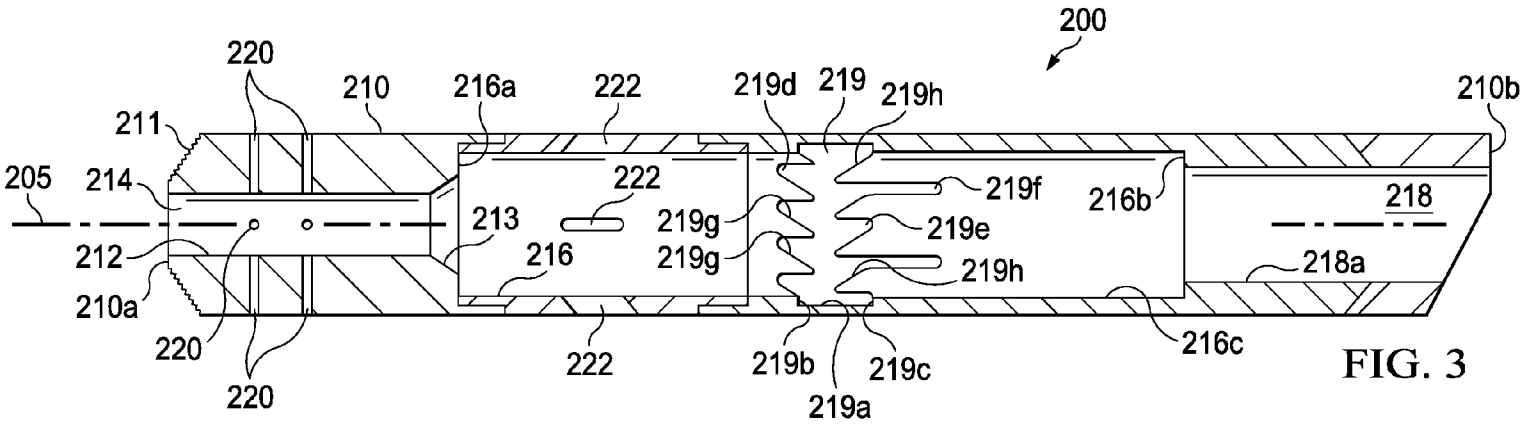
FIG. 3 is a cross-sectional view of an embodiment of a housing of a wellbore servicing tool.

Referring to FIG. 3, in an embodiment, housing 210 may comprise an inner bore surface 212 that extends axially from first terminal end 210*a* of housing 210 to gradient surface (e.g., beveled surface) 213 of housing 210 and generally defines axial flowbore 214. Ports 220 may be disposed on inner surface 212 and extend radially through housing 210. In an embodiment, housing 210 may generally define a first recessed bore 216. First recessed bore 216 may generally comprise a passageway (e.g., a circumferential recess extending a length parallel to longitudinal axis 205) in which at least a portion of mandrel 240 may move longitudinally, axially, radially, or combinations thereof within axial flowbore 214, as will be disclosed herein. First recessed bore 216 may be coaxially aligned with central axis 205 of housing 210 and is generally defined by an axially upper shoulder 216*a*, an axially lower shoulder 216*b* and a recessed radially inner surface 216*c* extending axially between upper shoulder 216*a* and lower shoulder 216*b*. Openings 222 may be disposed within the first recessed bore 216 on inner surface 216*c* and extend radially through housing 210.

In an embodiment, housing 210 may also generally define a second recessed bore 218. Second recessed bore 218 may be coaxially aligned with central axis 205 of housing 210 and may generally comprise a passageway (e.g., a circumferential recess extending a length parallel to longitudinal axis 205) in which at least a portion of mandrel 240 may move longitudinally, axially, radially, or combinations thereof within axial flowbore 214, as will be disclosed herein. Second recessed bore 218 is generally defined by a radially inner surface 218*a* that extends axially between lower shoulder 216*b* of first recessed bore 216 and second terminal end 210*b* of housing 210.

In an embodiment, housing 210 further comprises a recess or slot 219 configured to guide the rotational and axial movement of mandrel 240, as will be disclosed herein. In an embodiment, slot 219 may be characterized as a continuous slot. For example, slot 219 may comprise a continuous J-slot, a control groove, an indexing slot, or combinations thereof. As used herein, a continuous slot refers to a slot, such as a groove or depression having a depth beneath the inner surface 216*c* of the first recessed bore and extending entirely about (i.e., 360 degrees) the circumference of first recessed bore 216, though not necessarily in a single straight path. For example, as will be discussed herein, a continuous J-slot refers to a design configured to receive one or more protrusions or lugs coupled to and/or integrated within a component (e.g., mandrel 240), so as to guide the axial and/or rotational movement of that component through the J-slot, for example due to the physical interaction between the lug and the upper and lower shoulders of the slot. Although FIGS. 2-8 illustrate slot 219 as a continuous J-slot, in an embodiment, slot 219 may comprise a partial J-slot or other control groove or indexing mechanism configured to guide the rotational and/or axial movement of mandrel 240.

In the embodiment of FIG. 3, J-slot 219 is disposed on the inner surface 216*c* of first recessed bore 216. J-slot 219 radially extends partially through housing 210 and is generally defined by an axially upper shoulder 219*b* (e.g., which forms the upper bound of the slot 219), an axially lower shoulder 219*c* (e.g., which forms the lower bound of the slot 219) and an inner surface 219*a* extending between upper shoulder 219*b* and lower shoulder 219*c*. Inner surface 219*a* and upper shoulder 219*b* generally define one or more upper notches 219*d* extending axially upward (i.e., to the left in the Figures) toward first terminal end 210*a* of housing 210. One or more upper sloped edges 219*g* extend between each upper notch 219*d*, partially defining upper shoulder 219*b*. Also, inner surface 219*a* and lower shoulder 219*c* generally define one or more first or short lower notches 219*e* and one or more second or long lower notches 219*f* extending axially downward (i.e., to the right in the Figures) toward second terminal end 210*b* of housing 210. Long lower notches 219*f* extend farther axially in the direction of second terminal end 210*b* than short lower notches 219*e*. Moving radially around the circumference of inner surface 216*c*, each long lower notch 219*f* is followed by a short lower notch 219*e*, for example, thereby forming an alternating pattern of long lower notches 219*e* and short lower notches 219*f* (e.g., long lower notch 219*f*-short lower notch 219*e*-long lower notch 219*f*-short lower notch 219*e*, etc.). One or more lower sloped edges 219*h* extend between each long lower shoulder 219*f* and short lower shoulder 219*e*, partially defining lower shoulder 219*c*.

Figure 2:
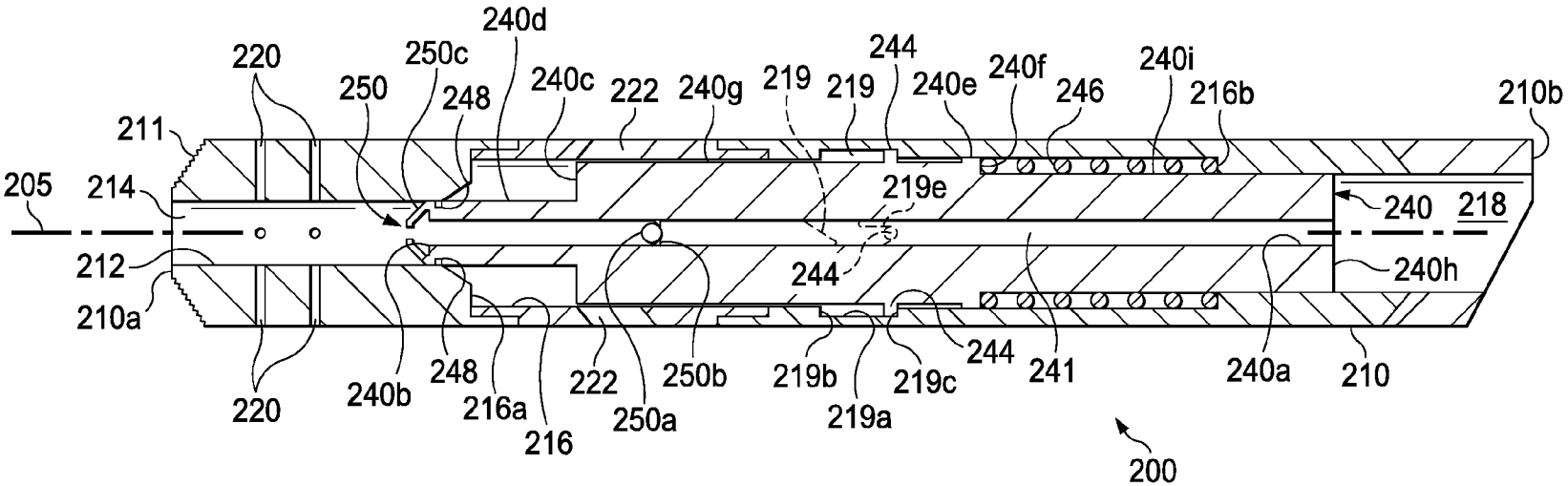
FIG. 2 is a cross-sectional view of an embodiment of a wellbore servicing tool.

Referring to FIG. 2, in an embodiment mandrel 240 generally comprises a cylindrical or tubular structure. In an embodiment, mandrel 240 generally comprises an inner cylindrical surface 240*a* that generally defines an axial flowbore 241 extending therethrough, an upper end 240*b*, an upper orthogonal face 240*c*, a first outer cylindrical surface 240*d* extending between upper end 240*b* and upper face 240*c*, a flange 240*e* partially defining a shoulder 240*f*, a second outer cylindrical surface 240*g* extending between upper face 240*c* and flange 240*f*, a lower end 240*h* and a third outer cylindrical surface 240*i* extending between shoulder 240*f* and lower end 240*h*. In an embodiment, axial flowbore 241 may be coaxial with central axis 205 and in fluid communication with axial flowbore 214 defined by housing 210. In the embodiment of FIGS. 2 and 4-8, mandrel 240 may comprise a single component piece. In an alternative embodiment, a mandrel like mandrel 240 may comprise two or more operably connected or coupled component pieces.

In an embodiment, mandrel 240 further comprises one or more lugs 244 configured to be received within a slot or indexing mechanism (e.g., slot 219) and to cooperatively control the rotational and/or axial displacement of mandrel 240, for example, via interaction with such a slot or indexing mechanism (e.g., slot 219). For example, in the embodiment of FIG. 2, mandrel 240 comprises one or more protrusions or lugs 244 disposed on the second outer cylindrical surface 240*g*. Lugs 244 extend radially outward from outer cylindrical surface 240*g* of mandrel 240 and are configured (e.g., sized) to slidably fit within slot 219 of housing 210, as will be disclosed herein in greater detail.

In an embodiment, mandrel 240 may be slidably and concentrically positioned within housing 210. For example, in the embodiment of FIGS. 2, 5-8, mandrel 240 may be positioned within the axial flowbore 214 of housing 210. At least a portion of mandrel 240 may be slidably fitted against a portion of the first recessed bore 216 of housing 210. For example, as illustrated in FIGS. 2, 5-8, second outer cylindrical surface 240*g* of mandrel 240 may be slidably fitted against first recessed bore 216 of housing 210. Further, at least a portion of mandrel 240 may be slidably fitted against a portion of inner cylindrical surface 218 of housing 210. For example, as illustrated in FIGS. 2, 5-8, third outer cylindrical surface 240*i* may be slidably fitted against a portion of inner cylindrical surface 218 of housing 210.

In an embodiment, mandrel 240, housing 210 or both may comprise one or more seals at an interface between the mandrel 240 and the housing 210. For example, in the embodiment of FIGS. 2 and 4-8, the servicing tool 200 comprises a seal 248 at the interface between first outer cylindrical surface 240*d* of mandrel 240 and inner bore surface 212 of housing 210. In such an embodiment, mandrel 240 may further comprise one or more radial or concentric recesses or grooves configured to receive one or more suitable fluid seals 248 disposed on the outer cylindrical surface 240*d* to restrict movement via the interface between surface 240*d* and inner bore surface 212. Additionally and/or alternatively, additional seals may disposed at one or more additional interfaces between the mandrel 240 and the housing 210 and may be similarly disposed within a recess or groove within the mandrel 240 or the housing 210. Suitable seals include but are not limited to a T-seal, an O-ring, a gasket, or combinations thereof. In an additional embodiment metal, graphite, rod seals, piston seals, symmetrical seals, or combinations thereof.

In an embodiment, mandrel 240 and lugs 244 may be biased in a generally upward direction, for example, toward upper notches 219*d*. For example, in the embodiment of FIGS. 2 and 5-8, servicing tool 200 comprises a biasing member 246. In an embodiment, the biasing member 246 generally comprises a suitable structure or combination of structures configured to apply a directional force and/or pressure to mandrel 240 with respect to housing 210. Examples of suitable biasing members include a spring, a compressible fluid or gas contained within a suitable chamber, an elastomeric composition, a hydraulic piston, or the like. For example, in the embodiment of FIGS. 2 and 5-8, the biasing member 246 comprises a spring (e.g., a coiled, compression spring).

In the embodiment of FIG. 2, biasing member 246 is concentrically positioned about outer cylindrical surface 240*i* of mandrel 240. Biasing member 246 may be configured to apply a directional force to mandrel 240 with respect to housing 210. For example, in this embodiment, biasing member 246 is configured to apply an upward force relative to housing 210, via shoulder 240*f*, to the mandrel 240 throughout at least a portion of the length of the movement of mandrel 240. Engagement between biasing member 246 and shoulder 240*f* of mandrel 240 biases mandrel 240 axially upward toward upper terminal end 210*a* of housing 210, such that, if uninhibited, mandrel 240 will move axially upward.

In an embodiment, mandrel 240 may be configured to allow upward fluid flow via flowbore 241 of mandrel 240 to flowbore 214 of housing 210 and to restrict downward flow from flowbore 214 via flowbore 241. For example, in the embodiment of FIGS. 2 and 5-8, mandrel 240 further comprises a check valve 250. Check valve 250 generally comprises an obturating member 250*a*, a seat 250*b* and a cage 250*c*. Seat 250*b* is disposed on inner cylindrical surface 240*a* of mandrel 240 and extends radially into axial flowbore 241 of mandrel 240 creating a reduced flowbore diameter in comparison to the diameter of axial flowbore 241. In an embodiment, the seat 250*b* may be integral with (e.g., joined as a single unitary structure and/or formed as a single piece) and/or connected to mandrel 240. For example, in an embodiment, seat 250*b* may be attached to mandrel 240. In an alternative embodiment, a seat may comprise an independent and/or separate component from the mandrel.

Figure 4:
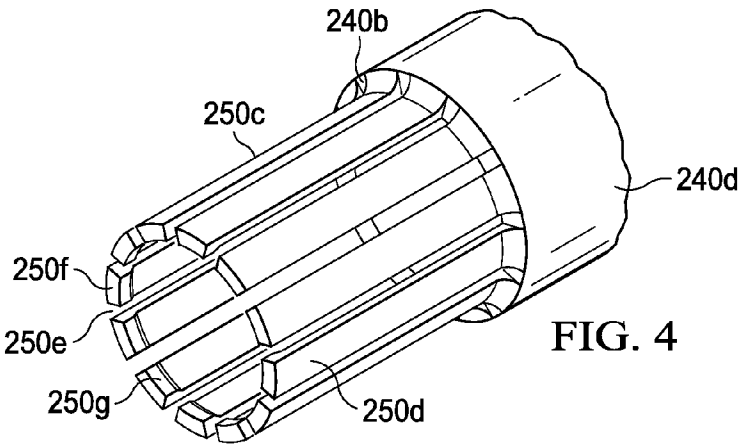
FIG. 4 is an isometric view of an embodiment of a check valve cage of a wellbore servicing tool.

Referring to FIG. 4, an embodiment of cage 250*c* is illustrated. In an embodiment, cage 250*c* is coupled to mandrel 240 at upper end 240*b* and may comprise a collet-type configuration including a plurality of fingers 250*d* having an axial terminal end 250*f*. Cage 250*c* may be integral with mandrel 240 or may comprise a separate component. Cage 250*c* is configured to retain obturating member 250*a* within or substantially within axial flowbore 241. For example, cage 250*c* comprises fingers 250*d*, each of the fingers 250*d* extending axially from upper end 240*b* of the mandrel and radially inward so as to create an inward protrusion 250*g* (e.g., a seat) sized and configured to restrict the obturating member from movement therethrough. A plurality of openings 250*e* are formed (e.g., radially) between fingers 250*d*, allowing for the bypassing of fluid flow through openings 250*e* while the obturating member 250*a* is retained. As such, the obturating member may be retained (e.g., within the axial flowbore 241 of the mandrel 240) by the seat (e.g., the lower boundary) and the cage (e.g., the upper boundary).

Obturating member 250*a* may be a ball, dart, plug or other device configured to create a restriction of the fluid flow along flowbore 241, for example, as the obturating member is pressed against seat 250*b* when fluid pressure above mandrel 240 is higher than fluid pressure below mandrel 240. Therefore, downward fluid flow via flowbore 241 causes obturating member 250*a* to physically engage seat 250*b*, thereby restricting fluid flow along flowbore 241 in the downward direction; alternatively, upward fluid flow via flowbore 241 causes obturating member 250*a* to disengage from seat 250*b* and be retained within cage 250*c*, thereby preventing member 250*a* from flowing farther upward.

Although FIGS. 2 and 5-8 illustrate check valve 250 as a ball-style check valve, in an alternative embodiment, a check valve may comprise another suitable configuration of check valves, for example, capable of allowing fluid movement in one axial direction while obstructing fluid communication in the opposite direction.

In the embodiment of FIG. 5, mandrel 240 is disposed in a first position within the housing 210, corresponding to the first configuration of wellbore servicing tool 200. In the first configuration of servicing tool 200, (e.g., where mandrel 240 is in the first position within housing 210) lugs 244 are disposed within upper notches 219*d* and physically contact upper shoulder 219*b* of slot 219. Where the mandrel 240 is in the first position, the mandrel 240 covers openings 222, thereby obstructing a route a fluid communication via the openings 222.

In the embodiment of FIG. 6, mandrel 240 is disposed in a second position within the housing 210, corresponding to the second configuration (or the jetting configuration) of wellbore servicing tool 200. In the second configuration of servicing tool 200, (e.g., where mandrel 240 is in the second position within the housing 210) lugs 244 of mandrel 244 are disposed within short lower notches 219*e* and are in physical engagement with lower shoulder 219*c* of slot 219. In the second position, mandrel 240 is disposed relatively more downward relative to the housing 210 in comparison to the first position of the mandrel 240. Further, in the second position of mandrel 240, biasing member 246 is further axially compressed in comparison to the compression of the biasing member 246 in the first position. In the second position, seal 248 provides for sealing engagement between outer cylindrical surface 240*d* of mandrel 240 and inner bore 212 of housing 210, for example, thereby restricting fluid communication between axial flowbore 214 and first recessed bore 216. However, fluid communication is provided along fluid flowpath 500 between axial flowbore 126 of work string 112 and an exterior of the housing via relatively high pressure ports 220. Where the mandrel 240 is in the second position, the mandrel 240 covers openings 222, thereby obstructing a route a fluid communication via the openings 222.

In the embodiment of FIG. 7, mandrel 240 is disposed in a third position, corresponding to the third configuration (or the fracturing configuration) of wellbore servicing tool 200. In the third configuration of servicing tool 200, (e.g., wherein mandrel 240 is in the third position) lugs 244 of mandrel 244 are disposed within long lower notches 219*f* and are in physical engagement with lower shoulder 219*c* of slot 219. In the third position, mandrel 240 is disposed relatively more downward relative to the housing 210 in comparison to both the first position of the mandrel 240 and the second position of the mandrel 240. Further, in the third position of mandrel 240, biasing member 246 is further axially compressed in comparison to both the first position and the second position. In the third position, seal 248 does not sealingly engage with inner bore 212 of housing 210, for example, thereby providing for fluid communication along fluid pathway 600 between axial flowbore 126 of work string 112 and an exterior of housing 210 via relatively high volume openings 222. Where the mandrel 240 is in the third position, the mandrel 240 does not cover openings 222, thereby allowing a route a fluid communication via the openings 222.

In an embodiment, mandrel 240 may be configured such that the application of a fluid and/or hydraulic pressure (e.g., a hydraulic pressure exceeding a threshold) to the axial flowbore 241 thereof will cause mandrel 240 to transition from the first position relative to housing 210 to either the second position relative to housing 210 or the third position relative to housing 210, as will be described herein. For example, in such an embodiment, mandrel 240 may be configured such that the application of fluid pressure to axial flowbore 241 (e.g., via, flowbores 126 and 214) results in a net hydraulic force applied to mandrel 240 in the axially downward direction (e.g., in the direction of the second and/or third positions). Specifically, the fluid and/or hydraulic force applied to mandrel 240 may be greater in the axial direction of the second and third positions than the sum of any forces applied in the opposite axial direction (e.g., upward forces resulting from fluid and/or hydraulic force as may result from a differential in the surface area of the downward-facing and upward-facing surfaces of the mandrel 240 and the force applied by biasing member 246).

In an embodiment, mandrel 240 may be configured such that the application of a biasing force upon the mandrel 240 in the axially upward direction (e.g., in the direction of the first position) that is greater in magnitude than any fluid and/or hydraulic pressure force upon mandrel 240 in the opposite axial direction will cause mandrel 240 to transition from either the second position or the third position to the first position. For example, in such an embodiment, mandrel 240 may be configured such that relieving a fluid pressure (e.g., releasing the fluid pressure and/or allow the fluid pressure to dissipate) applied to the mandrel 240 in the axially downward direction results in a next force applied to the mandrel 240 in the axially upward direction (e.g., in the direction of the first position). Specifically, the sum of any forces applied to mandrel 240 may be greater in the axial direction of the first position (e.g., hydraulic forces and the force applied by the biasing member 246) than the fluid and/or hydraulic forces applied in the opposite axial direction.

Further, in an embodiment, mandrel 240 may be configured to cycle between the second and third positions via the first position. Specifically, mandrel 240 may be configured to transition, as disclosed herein, from the first position to the second position (e.g., via a fluid and/or hydraulic force), from the second position back to the first position (e.g., via a biasing force) and from the first position to the third position (e.g., via a fluid and/or hydraulic force). Additionally, the mandrel may be configured to transition from the third position (e.g., via a biasing force) back to the first position. Upon returning to the first position (having most-recently departed the third position), the mandrel 240 may be configured such that, upon application of a fluid and/or hydraulic force, the mandrel will again be cycled to the second position. As such, the servicing tool 200 may be continually cycled from the first position to the second, from the second position back to the first position, then from the first position to the third position, and, from the third position back to the first position. In an embodiment, the configuration of the servicing tool 200 at a given point during a servicing operation may be ascertainable by an operator, for example, by noting fluid pumping pressures via one or more flowpaths (e.g., axial flowbore 126.

In the embodiment of FIGS. 2 and 5-8, slot 219 is a continuous J-slot that provides for several axial positions for lugs 244 corresponding to axial positions of mandrel 240 within housing 210. Thus, recessed inner surface 219*a* allows for lugs 244 to engage slot 219 throughout an entire rotation of mandrel 240. Lugs 244 may slide (axially and/or rotationally) within slot 219 in response to an upward and/or downward longitudinal force applied to mandrel 240.

In an embodiment, the transition between axial positions of mandrel 240 (e.g., first position, second position and third position) within housing 210 may be controlled by the physical interaction between lugs 244 and slot 219. Lugs 244 may also prevent mandrel 240 from moving beyond the range allowed by slot 219 due to the slidable engagement between lugs 244 and shoulders 219*b* and 219*c* of slot 219. The arrangement of slot 219 and lug 244 allows mandrel 240 to move axially and rotationally through slot 219. For example, as mandrel 240 is encouraged to move in an axial direction, lugs 244 are guided through slot 219 and into one of the notches 219*d*, 219*e*, or 219*f*. For instance, lugs 244 may start at a first position where they are disposed within one of upper notches 219*d* of slot 219, wherein an actuating force (e.g., a fluid or hydraulic force) is not being applied to mandrel 244 and a biasing force from biasing member 246 maintains lugs 244 within notch 219*d*.

Upon the application of an actuating force to mandrel 240 in the axially downward direction (e.g., a fluid or hydraulic force), mandrel 240 may be transitioned from the first position to the second position (alternatively, as will be discussed herein, to the third position). As mandrel 240 is displaced axially downward due to the application of the actuating force, lugs 244 are displaced downward within slot 219 until they contact lower sloped edges 219*h*. Contact between edges 219*h* and lugs 244 cause lugs 244 and mandrel 240 to rotate within housing 210 as lugs 244 slide along lower sloped edges 219*h* until lugs 244 become aligned with short lower notches 219*e*, where lugs 244 then move into short lower notches 219*e* and come to a rest against lower shoulder 219*c*, corresponding to the second position of mandrel 240.

Upon a reduction of the actuating force (e.g., a fluid or hydraulic force) such that the biasing force from biasing member 246 provides a net force on mandrel 240 in the axially upward direction, mandrel 240 may be transitioned from the second position to the first position. As mandrel 240 is displaced axially upward due to the force applied by the biasing member, lugs 244 are displaced upward within slot 219 until they contact upper sloped edges 219*g*. Contact between edges 219*g* and lugs 244 cause lugs 244 and mandrel 240 to rotate within housing 210 as lugs 244 slide along upper sloped edges 219*g* until lugs 244 become aligned with upper notches 219*d*, where lugs 244 then move into upper notches 219 and come to a rest against upper shoulder 219*b*, corresponding to the first position of mandrel 240.

Upon the application of an actuating force to mandrel 240 in the axially downward direction (e.g., a fluid or hydraulic force), mandrel 240 may be transitioned from the first position to the third position (e.g., where the mandrel 240 has most recently departed the second position). As mandrel 240 is displaced axially downward due to the application of the actuating force, lugs 244 are displaced downward within slot 219 until they contact lower sloped edges 219*h*. Contact between edges 219*h* and lugs 244 cause lugs 244 and mandrel 240 to rotate within housing 210 as lugs 244 slide along lower sloped edges 219*h* until lugs 244 enter long lower notch 219*f*. Lugs 244 and mandrel 244 may continue to displace downward until lugs 244 come to a rest against lower shoulder 219*c* of long lower notches 219*f*, corresponding to the third position of mandrel 240. In such an embodiment, the overall cycling of mandrel 240 in an axially downward and upward motion results in lugs 244 of mandrel 240 being cycled between displacement in upper notches 219*d*, short lower notches 219*e*, upper notches 219*d*, and long lower notches 219*f*.

In an embodiment, to transition wellbore servicing tool 200 from the first configuration of servicing tool 200 (e.g., the unset mode, illustrated in FIG. 5) to the second or jetting configuration (e.g., illustrated in FIG. 6), fluid pressure within axial flowbore 126 of work string 112 may be increased to a threshold level where a net force acts on mandrel 240 in the axially downward direction. The threshold level of pressure within axial flowbore 126 will be such that the pressure force applied on mandrel 240 in the downward direction overcomes the biasing force from biasing member 246 applied on mandrel 240 in the upward direction. Increasing fluid pressure within axial flowbore 126 results in a force on mandrel 240 in the downward direction due to obstructions in downward flow caused by seal 248 and check valve 250. Specifically, sealing engagement between outer cylindrical surface 240*d* and inner bore 212 created by seal 248 of mandrel 240 obstructs flow between axial flowbore 214 and openings 222 of housing 210. Also, check valve 250 within axial flowbore 241, with obturating member 250*a* in contact with seat 250*b*, obstructs flow across flowbore 241. The obstruction created by check valve 250 results in hydraulic pressure being applied to mandrel 240 in the downward direction, displacing mandrel 240 axially downward against the biasing force of biasing member 246 from the first position of mandrel 240 to the second position of mandrel 240, corresponding to the jetting mode and second configuration of servicing tool 200. As mandrel 240 is displaced downward, lugs 244 are displaced from upper notches 219*d* into short lower notches 219*e* of slot 219. The fluid obstruction caused by check valve 250 and the sealing engagement provided by seal 248 forces fluid within axial flowbore 214 along flowpath 500 through relatively high pressure ports 220 to an exterior of housing 210.

In an embodiment, in order to transition wellbore servicing tool 200 from the jetting mode to the third, mixing, or fracturing configuration of servicing tool 200, pressure within axial flowbore 126 of work string 112 may be reduced (e.g., allowed to dissipate), in turn reducing the fluid pressure acting on mandrel 240 in the downward direction. This allows biasing member 246 to displace mandrel 240 upward into the first position, with lugs 244 displaced upward from short lower notches 219*e* into upper notches 219*d* of slot 219. Once in the first configuration of servicing tool 200, hydraulic pressure may be applied against mandrel 240, displacing lugs 244 of mandrel 240 downward from upper notches 219*d* into long lower notches 219*f* of slot 219, allowing mandrel 240 to be displaced from its first position to its third position, corresponding to the third, mixing, or fracturing configuration, for example, as shown in FIG. 7. The fluid obstruction caused by check valve 250 directs fluid through relatively high volume openings 222 and to the proximate and/or substantially adjacent zone of the subterranean formation 102. In an embodiment, openings 222 are configured to provide for a larger cross-sectional area and thus a lesser flow restriction than ports 220, allowing a larger volume of fluid flowing through openings 222 than ports 220.

In an embodiment, wellbore servicing tool 200 may be configured to transition from third, mixing, or fracturing configuration (e.g., FIG. 7) to the second, jetting configuration (e.g., FIG. 6). In such an embodiment, in order to transition wellbore servicing tool 200 from the third, mixing, or fracturing configuration to the second, jetting configuration, pressure within axial flowbore 126 of work string 112 may be reduced, in turn reducing the fluid pressure acting on mandrel 240 in the downward direction. This allows biasing member 246 to displace mandrel 240 upward into the first configuration, with lugs 244 displaced upward from long lower notches 219*f* into upper notches 219*d* of slot 219. Once in the first configuration of servicing tool 200, hydraulic pressure may be applied against mandrel 240, displacing lugs 244 of mandrel 240 downward from upper notches 219*d* into short lower notches 219*e* of slot 219, allowing mandrel 240 to again be displaced from its first position (e.g., FIGS. 5 and 8) to its second position (e.g., FIG. 6), corresponding to the second, jetting configuration.

In an embodiment, wellbore servicing tool 200 may be configured to allow for the recirculation of a fluid via the axial flowbore 241 of the mandrel 240. For example, in an embodiment, when the wellbore servicing tool 200 is in the first configuration, particularly, in the unset mode, the servicing tool 200 may be transitioned to the recirculation mode (e.g., as illustrated in FIG. 8). For example, in order to transition the servicing tool to the recirculation mode, pressure differential may be created between axial flowbore 126 and an exterior to the housing 210, particularly, such that the pressure within the axial flowbore 126 is less than the pressure exterior to the housing 210. Such a pressure differential may result from providing suction within axial flowbore 126, reverse circulating a fluid, allowing fluids exterior to the housing to create a fluid pressure, or combinations thereof. In an embodiment, the pressure differential may cause the obturating member 250*a* of the check valve 250 to disengage the seat 250*b* and be retained by cage 250*c* while allowing fluid communication via flowpath 400, through axial flowbore 241 of mandrel 240 and into the axial flowbore 126 of work string 112. Specifically, for example, with reference to FIG. 4, with obturating member 250*a* held by inward protrusions 250*g* of the cage 250*c*, flowpaths will be provided in the areas between fingers 250*d* (e.g., openings 250*e*), allowing fluid to flow out of and/or bypass the cage 250*c*.

In an embodiment, wellbore servicing tool 200 may be transitioned from the recirculation mode of the first configuration to the unset mode of the first configuration. In such an embodiment, in order to transition wellbore servicing tool 200 from the recirculation mode to the unset mode, pressure within axial flowbore 126 of work string 112 may be increased to such that the fluid pressure within the axial flowbore 126 is greater than the fluid pressure exterior to the servicing tool 200. As such, the obturating member 250*a* of the check valve 250 will engage the seat 250*b* so as to obstruct fluid communication via the axial flowbore 241 of the mandrel. From the unset mode of the first configuration, the servicing tool may be transitioned to either the second or the third configuration (e.g., depending upon the alignment of the lugs with respect to the slot 219).

One or more of embodiments of a wellbore servicing system 100 comprising a wellbore servicing tool like wellbore servicing tool 200 having been disclosed, one or more embodiments of a wellbore servicing method employing such a wellbore servicing system 100 and/or such wellbore servicing tools 200 are also disclosed herein. In an embodiment, a wellbore servicing method may generally comprise the steps of positioning a wellbore servicing tool within a wellbore proximate to a zone of a subterranean formation, configuring the wellbore servicing tool for performing a jetting operation, communicating a wellbore servicing fluid at a pressure sufficient to form one or more perforations via the servicing tool, configuring the wellbore servicing tool for performing a or fracturing operation, and communicating a wellbore servicing fluid and/or a component thereof at a rate and pressure sufficient to form or extend one or more fractures within the zone proximate to the servicing tool via the servicing tool.

In an additional embodiment, upon completion of the servicing operation with respect to a given zone, the servicing tool may be moved to another zone and the process of configuring the wellbore servicing tool for performing a jetting operation, communicating a wellbore servicing fluid at a pressure sufficient to form one or more perforations via the servicing tool, configuring the wellbore servicing tool for performing a or fracturing operation, and communicating a wellbore servicing fluid and/or a component thereof at a rate and pressure sufficient to form or extend one or more fractures within the zone proximate to the servicing tool via the servicing tool may be repeated, for as many formation zones as may be present within the subterranean formation.

In an embodiment, a wellbore servicing tool may be incorporated within a work string like work string 112 of FIG. 1, and may be positioned within a wellbore like wellbore 114. For example, in the embodiment of FIG. 1, work string 112 has incorporated therein a wellbore servicing tool 200. Also in this embodiment, work string 112 is positioned within wellbore 114 such that the servicing tool 200 is proximate and/or substantially adjacent to formation zone 12. In an embodiment, wellbore servicing tool 200 may be positioned within wellbore 114 in the first configuration, for example, in an unset mode. In an embodiment, servicing tool 200 is configured in the first configuration so as to transition to the second, jetting configuration upon actuation.

In an embodiment, for example, in the embodiment of FIGS. 1 and 5-8, the wellbore may be cased with a casing like casing 120. Also, in such an embodiment, the casing 120 may be secured in place with cement, for example, such that a cement sheath (e.g., cement 122) surrounds the casing 120 and fills the void space between the casing 120 and the walls of the wellbore 114. Although the embodiments of FIGS. 1 and 5-8 illustrate, and the following disclosure may reference, a cased, cemented wellbore, one of skill in the art will appreciate that the methods disclosed herein may be similarly employed in an uncased wellbore or a cased, uncemented wellbore, for example, where the casing is secured utilized a packer or the like.

In an embodiment, the zones of the subterranean formation may be serviced beginning with the zone that is furthest down-hole (e.g., in the embodiment of FIG. 1, formation zone 12) moving progressively upward toward the furthest up-hole zone (e.g., in the embodiment of FIG. 1, formation zone 2). In alternative embodiments, the zones of the subterranean formation may be serviced in any suitable order, as will be appreciated by one of skill in the art upon viewing this disclosure.

In an embodiment, once the work string comprising a wellbore servicing tool has been positioned within the wellbore, the wellbore servicing tool may be prepared for the communication of a fluid to the wellbore at a pressure suitable for a jetting operation. Referring to FIGS. 1, 5, and 6, in such an embodiment, servicing tool 200, which is positioned proximate and/or substantially adjacent to the first zone to be serviced (e.g., formation zone 12), is transitioned from the first configuration (for example, the unset mode of the first configuration) to the second, jetting configuration (e.g., FIG. 6).

In an embodiment where the wellbore servicing tool is pressure activated, transitioning servicing tool 200 to the second, jetting configuration may comprise pumping fluid via the flowbore 126 of the work string 112 so as to increase the fluid pressure within work string 112 (e.g., within flowbore 126). The increased fluid pressure within work string 112 activates check valve 250, thereby seating obturating member 250*a* on seat 250*b*, which restricts flow through axial flowbore 241 of mandrel 240. The restriction created by check valve 250 applies a downward force to mandrel 240. When the downward force applied to the mandrel 240 exceeds the force in the axially upward direction provided by biasing member 246, the mandrel 240 shifts downward and lugs 244 move rotationally and axially as they follow the profile of slot 219. Specifically, lugs 244 are displaced from upper notches 219*d* within recess 219*a* to short lower notches 219*e*. As lugs 244 enter short lower notches 219*e* and engage lower shoulder 219*c*, mandrel 240 comes to rest in the second position, corresponding to the second, jetting configuration of wellbore servicing tool 200.

In an embodiment, with the servicing tool in the second, jetting configuration, a wellbore servicing fluid may be communicated, for example, via axial flowbore 214 of housing 210, through ports 220 (e.g., high-pressure ports 220), and into the wellbore 114 (for example, as illustrated by flow arrow 500 of FIG. 6). Also, in an embodiment, ports 220 may be fitted with one or more pressure-altering devices (e.g., nozzles, erodible nozzles, or the like) to increase the dynamic pressure of fluid emitted from ports 220. Flow of servicing fluid is restricted between axial flowbore and openings 222 by the sealing engagement between cylindrical outer surface 240*d* of mandrel 240 and inner bore 212 of housing 210 provided by seal 248. Nonlimiting examples of such a suitable wellbore servicing fluid include but are not limited to a perforating or hydrajetting fluid and the like, or combinations thereof. The wellbore servicing fluid may be communicated at a suitable rate and pressure for a suitable duration. For example, the wellbore servicing fluid may be communicated at a rate and/or pressure sufficient to create one or more perforations and/or to initiate fluid pathways (e.g., perforations 130) within a casing string, a cement sheath, and/or the subterranean formation 102 and/or a zone thereof.

In an embodiment, when a desired amount of the servicing fluid has been communicated, for example, sufficient to create a desired number of perforations such as perforation 130, an operator may cease the communication of fluid, for example, by ceasing to pump the servicing fluid into work string 112, and thereby transition the servicing tool from the second, jetting configuration to the third, mixing or fracturing configuration. As the pressure is decreased within work string 112, upward axial force applied to mandrel 240 (e.g., applied by biasing member 246) overcomes the axially downward forces applied to mandrel 240, and produces a net force in the upward axial direction. The resulting net upward force shifts mandrel 240 axially upward into the first configuration as lugs 244 move rotationally and axially, following the profile of slot 219, and are displaced from short lower notches 219*e* into upper notches 219*d* of slot 219. As the lugs 244 enter the upper notches 219*d*, the mandrel 240 again comes to rest in the first position, corresponding to the first configuration.

In an embodiment, once mandrel 240 within wellbore servicing tool 200 has transitioned from the second configuration to the first configuration, the servicing tool 200 may be transitioned into a third, mixing or fracturing configuration.

Referring to FIGS. 1, 5, and 7, in an embodiment where the wellbore servicing tool is pressure activated, transitioning servicing tool 200 to the third, mixing or fracturing configuration may again comprise pumping fluid via the flowbore 126 of the work string 112 (e.g., within flowbore 126). The increased fluid pressure within work string 112 activates check valve 250, which restricts flow across axial flowbore 241 of mandrel 240. The restriction created by check valve 250 applies a downward force to mandrel 240. When the downward force applied to the mandrel 240 exceeds axially upward force provides by biasing member 246, the mandrel 240 shifts downward and lugs 244 move rotationally and axially within slot 219. Specifically, lugs 244 are displaced from upper notches 219*d* within recess 219*a* to long lower notches 219*f* of slot 219. As lugs 244 enter long lower notches 219*f* and engage lower shoulder 219*c*, mandrel 240 comes to rest in the third position, corresponding to the third, mixing or fracturing configuration of the wellbore servicing tool 200. The additional axial length of long lower notches 219*f* (in comparison to short lower notches 219*e*) allows for additional axial displacement of mandrel 240 downward such that seal 248 of mandrel 240 is no longer in sealing engagement with inner bore surface 212 of housing 210. In an embodiment, the servicing tool 200 may be held relatively static with respect to the formation 102 during or substantially contemporaneously with the reconfiguration of the tool; alternatively, the servicing tool may be moved (e.g., upward and/or downward) during and/or substantially contemporaneously with the reconfiguration of the tool (for example, to align openings 222 with perforations 130).

In an embodiment, with the servicing tool in the third, mixing or fracturing configuration, a wellbore servicing fluid may be communicated, for example, from axial flowbore 214 of housing 210, through openings 222, and to the proximal subterranean formation zone 12 (for example, as illustrated by flow arrow 600) at a relatively higher volume but lower dynamic pressure than through ports 220 when in the jetting mode. Nonlimiting examples of a suitable wellbore servicing fluid include but are not limited to a fracturing fluid, an acidizing fluid, the like, or combinations thereof. In an additional embodiment, the wellbore servicing fluid may also comprise a composite fluid comprising a first component and a second component, where the first component may be displaced downhole through a first flow path (e.g., axial flowbore 126 of work string 112) and the second component may be displaced downhole through a second flow path (e.g., an annular space 300 surrounding the work string 112). In such an embodiment, the first component and second component may be mixed within the wellbore prior to and/or substantially contemporaneously with movement into the subterranean formation 102 (e.g., via fractures 132). Composite fluids and methods of utilizing the same in the performance of a wellbore servicing operation are disclosed in U.S. application Ser. No. 12/358,079, published as US 2010-0044041 A1, which is incorporated herein by reference in its entirety, for all purposes. The wellbore servicing fluid may be communicated at a suitable rate and volume for a suitable duration. For example, the wellbore servicing fluid may be communicated at a rate and/or pressure sufficient to initiate and/or extend a fluid pathway (e.g., fracture 132) within the subterranean formation 102 and/or a zone thereof (e.g., one of zones 2, 4, 6, 8, 10, or 12).

In an embodiment, when a desired amount of the servicing fluid and/or composite fluid has been communicated to formation zone 12, an operator may cease the communication of fluid to formation (e.g., formation zone 12). In an embodiment, upon completion of the servicing operation with respect to a given zone, the servicing tool may be removed to another zone and the process of configuring the wellbore servicing tool for performing a jetting operation, communicating a wellbore servicing fluid at a pressure sufficient to form one or more perforations via the servicing tool, configuring the wellbore servicing tool for performing a or fracturing operation, and communicating a wellbore servicing fluid and/or a component thereof at a rate and pressure sufficient to form or extend one or more fractures within the zone proximate to the servicing tool via the servicing tool, may be repeated with respect the relatively more up-hole formation zones 2, 4, 6, 8 and 10. In an embodiment, wellbore servicing tool 200 may be displaced uphole until it is proximal formation zone 10, wherein this process may be repeated. In such an embodiment, the operator may choose to isolate a relatively more downhole zone (e.g., zone 12) that has already been serviced, for example, for the purpose of restricting fluid communication into that zone. In such an embodiment, such isolation may be provided via a sand and/or proppant plug upon the termination of the servicing operation with respect to each zone. In an alternative embodiment, such isolation may be provided via a mechanical plug or packer (e.g., a fracturing plug). For example, in such an embodiment, such a mechanical plug or packer may be set, unset, and reset via interaction with the wellbore servicing tool 200 (e.g., via a mating assembly at the downhole end of the servicing tool 200), a wireline tool, a fishing neck tool, or the like.

Referring to FIGS. 1, 7 and 8, in an embodiment an operator may optionally transition wellbore servicing tool 200 into a recirculation mode. As described previously, pressure may be decreased within work string 112 through the cessation of the displacement of fluid into work string 112 from the surface 104. As fluid pressure is decreased within work string 112, the biasing force on mandrel 240 in the upward axial direction produced by biasing member 246 creates a net force in the upward axial direction, overcoming the decreasing force applied to mandrel 240 by fluid within axial flowbore 214 on mandrel 240 in the downward axial direction. Once fluid pressure within axial flowbore 214 decreases below the fluid pressure of fluid in the surrounding formation zone 12, mandrel 240 shifts upward into the first position as lugs 244 are displaced from long lower notches 219*f* into upper notches 219*d* along recess 219*a* of slot 219 and check valve 250 opens as obturating member 250*a* is displaced axially toward cage 250*c*, allowing for the bypassing of fluid around the member 250*a* along fluid flowpath 400. In the recirculation mode, formation fluids from zone 12 may be communicated to the axial flowbore 126 of work string 112 through axial flowbore 241 of mandrel 240. The process disclosed herein may thereafter be repeated with respect one or more of the up-hole formation zones 2, 4, 6, 8 and 10.

In an embodiment, a wellbore servicing tool such as servicing tool 200, a wellbore servicing system such as wellbore servicing system 100 comprising a wellbore servicing tool such as servicing tool 200, a wellbore servicing method employing such a wellbore servicing system 100 and/or such a wellbore servicing system 200, or combinations thereof may be advantageously employed in the performance of a wellbore servicing operation. For example, as disclosed herein, a wellbore servicing tool such as servicing tool 200 may allow an operator to cycle a servicing tool as disclosed herein, for example, servicing tool 200, between a jetting mode and a mixing or fracturing mode without the need to communicate an obturating member (e.g., a ball, dart and the like) from the surface 104 to the servicing tool 200 and without the need to remove the servicing tool 200 from the wellbore. The ability to transition servicing tool 200 from a jetting mode to a mixing or fracturing mode without communicating an obturating member and without removing the tool from the wellbore may reduce the total time needed to perform the wellbore stimulation procedure. Also, the servicing tool does not rely on introducing and landing an obturating member on a seat within the tool so as to transition the tool from a given mode to another mode, and, therefore does not present the possibility of obturating members failing to land on their associated seats, due to erosion or other factors. As such, the servicing tool 200 may be operated in a wellbore servicing operation as disclosed herein with improved reliability in comparison to conventional servicing tools.

ADDITIONAL DISCLOSURE

The following are nonlimiting, specific embodiments in accordance with the present disclosure:

Embodiment 1

An apparatus for servicing a wellbore comprising:

a housing defining an axial flowbore extending therethrough and comprising:

one or more high-pressure ports; and one of more high-volume ports; and a mandrel slidably positioned within the housing, the mandrel defining a mandrel axial flowbore and being alternatingly movable from a first position relative to the housing to a second position relative to the housing and to a third position relative to the housing, wherein, when the mandrel is in the second position, a route of fluid communication via the one or more high-pressure ports is provided and a route of fluid communication via the high-volume ports is obstructed, wherein, when the mandrel is in the third, position, a route of fluid communication via the high-volume ports is provided, and wherein the apparatus is transitionable from the second position to the third position without communicating an obturating member to the apparatus, without removing an obturating member from the apparatus, or combinations thereof.

Embodiment 2

The apparatus of embodiment 1, further comprising:

wherein the housing further comprises a J-slot and the mandrel further comprises at least one lug, wherein the at least one lug is slidably positioned within the J-slot.

Embodiment 3

The apparatus of embodiment 2, wherein the J-slot comprises:

an upper profile comprising a plurality of upper notches; and a lower profile comprising a plurality of lower short notches and a plurality of lower long notches, wherein lower short notches and the lower long notches are alternatingly displaced within the lower profile.

Embodiment 4

The apparatus of embodiment 3, wherein the at least one lug of the mandrel occupies one of the plurality of upper notches in the J-slot when the mandrel is in the first position.

Embodiment 5

The apparatus of embodiment 3, wherein the at least one lug of the mandrel occupies one of the plurality of lower short notches in the J-slot when the mandrel is in the second position.

Embodiment 6

The apparatus of embodiment 3, wherein the at least one lug of the mandrel occupies one of the plurality of lower long notches in the J-slot when the mandrel is in the third position.

Embodiment 7

The apparatus of one of embodiments 1 through 6, further comprising a biasing member configured to bias the mandrel in the direction of the first position.

Embodiment 8

The apparatus of claim 1, wherein the mandrel further comprises a check valve within the mandrel axial flowbore, wherein the check valve is configured to restrict downward fluid communication via the mandrel flowbore and to permit upward fluid communication via the mandrel flowbore.

Embodiment 9

The apparatus of one of embodiments 1 through 7, wherein the jetting ports are configured for a relatively high-pressure communication of fluid relative to the fracturing ports.

Embodiment 10

The apparatus of one of embodiments 1 through 8, wherein the fracturing ports are configured for a relatively high-volume communication of fluid relative to the jetting ports.

Embodiment 11

A system for servicing a wellbore comprising:

a tubular disposed within the wellbore;

a wellbore servicing apparatus coupled to a downhole end of the tubular, the wellbore servicing apparatus being transitionable between a jetting configuration and a fracturing configuration, wherein the wellbore servicing apparatus is configured to cycle between the jetting configuration and the fracturing configuration without communicating an obturating member to the wellbore servicing apparatus, without removing an obturating member from the wellbore servicing apparatus, or combinations thereof.

Embodiment 12

The system of embodiment 11, wherein the wellbore servicing apparatus comprises:

a housing defining an axial flowbore extending therethrough and comprising:

one or more high-pressure ports; and one of more high-volume ports; and a mandrel slidably positioned within the housing, the mandrel defining a mandrel axial flowbore and being alternatingly movable from a first position relative to the housing to a second position relative to the housing and to a third position relative to the housing, wherein, when the mandrel is in the second position, the apparatus is configured in the jetting configuration, and wherein, when the mandrel is in the third position, the apparatus is configured in the fracturing configuration.

Embodiment 13

A method for servicing a wellbore comprising:

positioning a wellbore servicing apparatus within the wellbore proximate to a first subterranean formation zone;

configuring the wellbore servicing apparatus to deliver a jetting fluid without communicating an obturating member to the wellbore servicing apparatus, without removing an obturating member from the wellbore servicing apparatus, or combinations thereof;

communicating the jetting fluid via the wellbore servicing apparatus;

configuring the wellbore servicing apparatus to deliver a fluid at a rate and pressure sufficient to form and/or extend a fracture within the first subterranean formation zone without communicating an obturating member to the wellbore servicing apparatus, without removing an obturating member from the wellbore servicing apparatus, or combinations thereof;

forming a fracture within the first subterranean formation zone by communicating a fluid via the wellbore servicing apparatus.

Embodiment 14

The method of embodiment 13, wherein communicating the jetting fluid via the wellbore servicing apparatus forms a perforation within a casing, a cement sheath, a wellbore wall, or combinations thereof.

Embodiment 15

The method of one of embodiments 13 through 14, wherein configuring the wellbore servicing apparatus to deliver the jetting fluid comprises making a first application of fluid pressure to an axial flowbore of the wellbore servicing apparatus.

Embodiment 16

The method of embodiment 15, wherein the first application of the pressure transitions a mandrel within the wellbore servicing apparatus from a first axial position relative to a housing of the wellbore servicing tool to a second axial position relative to the housing.

Embodiment 17

The method of embodiment 16, wherein configuring the wellbore servicing apparatus to deliver a fluid at a rate and pressure sufficient to form and/or extend a fracture comprises:

releasing the first application of pressure;

making a second application of fluid pressure to the axial flowbore.

Embodiment 18

The method of embodiment 17, wherein releasing the first application of pressure transitions the mandrel from the second axial position to the first axial position.

Embodiment 19

The method of embodiment 18, wherein the second application of pressure transitions the mandrel from the first axial position to a third axial position relative to the housing.

Embodiment 20

The method of one of embodiments 13 through 19, further comprising:

after forming a fracture within the first subterranean formation zone, positioning the wellbore servicing apparatus within the wellbore proximate to a second subterranean formation zone;

configuring the wellbore servicing apparatus to deliver a jetting fluid without communicating an obturating member to the wellbore servicing apparatus, without removing an obturating member from the wellbore servicing apparatus, or combinations thereof;

communicating the jetting fluid via the wellbore servicing apparatus;

configuring the wellbore servicing apparatus to deliver a fluid at a rate and pressure to form and/or extend a fracture within the second subterranean formation zone without communicating an obturating member to the wellbore servicing apparatus, without removing an obturating member from the wellbore servicing apparatus, or combinations thereof;

forming a fracture within the second subterranean formation zone by communicating a fluid via the wellbore servicing apparatus.

Embodiment 21

The method of one of embodiments 13 through 20, wherein forming the fracture within the first subterranean formation zone by communicating a fluid via the wellbore servicing apparatus comprises communicating a proppant-laden fluid.

Embodiment 22

The method of embodiment 21, wherein forming the fracture within the first subterranean formation zone by communicating a fluid via the wellbore servicing apparatus comprises forming a composite fracturing fluid within the wellbore, the fracture, or combinations thereof.

While embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: $R=Rl+k*(Ru-Rl)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention. The discussion of a reference in the Detailed Description of the Embodiments is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. An apparatus for servicing a wellbore comprising:

a housing defining an axial flowbore extending therethrough and comprising:

one or more high-pressure ports; and one of more high-volume ports, wherein the high-pressure ports are configured for a relatively high-pressure communication of fluid relative to the high-volume ports and wherein the high-volume ports are configured for a relatively high-volume communication of fluid relative to the high-pressure ports; and a mandrel slidably positioned within the housing, the mandrel defining a mandrel axial flowbore, the mandrel being movable;

from a first longitudinal position relative to the housing to a second longitudinal position relative to the housing, from the second longitudinal position to the first longitudinal position, and after returning to the first longitudinal position from the second longitudinal position, from the first longitudinal position to a third longitudinal position relative to the housing, wherein the mandrel further comprises a check valve within the mandrel axial flowbore, wherein the check valve is configured to restrict downward fluid communication via the mandrel flowbore and to permit upward fluid communication via the mandrel flowbore, and wherein the check valve comprises a obturating member trapped between an upper cage and a lower seat within the mandrel axial flowbore, wherein, when the mandrel is in the first longitudinal position, a route of fluid communication via the high-volume ports is obstructed, wherein, when the mandrel is in the second longitudinal position, a route of fluid communication via the one or more high-pressure ports is provided and the route of fluid communication via the high-volume ports is obstructed, and wherein, when the mandrel is in the third position, the route of fluid communication via the high-volume ports is provided wherein the apparatus is transitionable from the second position to the third position without communicating an obturating member to the apparatus, without removing an obturating member from the apparatus, or combinations thereof.

2. The apparatus of claim 1, wherein the housing further comprises a J-slot and the mandrel further comprises at least one lug, wherein the at least one lug is slidably positioned within the J-slot.

3. The apparatus of claim 2, wherein the J-slot comprises:

an upper profile comprising a plurality of upper notches; and a lower profile comprising a plurality of lower short notches and a plurality of lower long notches, wherein lower short notches and the lower long notches are alternatingly displaced within the lower profile.

4. The apparatus of claim 3, wherein the at least one lug of the mandrel occupies one of the plurality of upper notches in the J-slot when the mandrel is in the first longitudinal position.

5. The apparatus of claim 3, wherein the at least one lug of the mandrel occupies one of the plurality of lower short notches in the J-slot when the mandrel is in the second longitudinal position.

6. The apparatus of claim 3, wherein the at least one lug of the mandrel occupies one of the plurality of lower long notches in the J-slot when the mandrel is in the third longitudinal position.

7. The apparatus of claim 1, further comprising a biasing member configured to bias the mandrel in the direction of the first longitudinal position.

8. A system for servicing a wellbore comprising:

a tubular disposed within the wellbore;

a wellbore servicing apparatus coupled to a downhole end of the tubular, the wellbore servicing apparatus being transitionable between a jetting configuration and a fracturing configuration, wherein the wellbore servicing apparatus comprises:

a housing defining an axial flowbore extending therethrough and comprising:

one or more high-pressure; and one of more high-volume ports, wherein the high-pressure ports are configured for a relatively high-pressure communication of fluid relative to the high-volume ports and wherein the high-volume ports are configured for a relatively high-volume communication of fluid relative to the high-pressure ports; and a mandrel slideably positioned within the housing, the mandrel defining a mandrel axial flowbore, the mandrel being moveable;

from a first longitudinal position relative to the housing to a second longitudinal position relative to the housing, from the second longitudinal position to the first longitudinal position, and after returning to the first longitudinal position from the second longitudinal position, from the first longitudinal position to a third longitudinal position relative to the housing, wherein the mandrel further comprises a check valve within the mandrel axial flowbore, wherein the check valve is configured to restrict downward fluid communication via the mandrel flowbore and to permit upward fluid communication via the mandrel flowbore, and wherein the check valve comprises a obturating member trapped between an upper cage and a lower seat within the mandrel axial flowbore, wherein, when the mandrel is in the first longitudinal position, a route of fluid communication via the high-volume ports is obstructed, wherein, when the mandrel is in the second longitudinal position, a route of fluid communication via the one or more high-pressure ports is provided and the route of fluid communication via the high-volume ports is obstructed, and wherein, when the mandrel is in the third longitudinal position, the route of fluid communication via the high-volume ports provided.

9. The system of claim 8, wherein the housing further comprises a J-slot and the mandrel further comprises at least one lug, wherein the at least one lug is slidably positioned within the J-slot, wherein the J-slot comprises:

an upper profile comprising a plurality of upper notches; and a lower profile comprising a plurality of lower short notches and a plurality of lower long notches, wherein lower short notches and the lower long notches are alternatingly displaced within the lower profile.

10. The system of claim 8, further comprising a biasing member configured to bias the mandrel in the direction of the first longitudinal position.

11. A method for servicing a wellbore comprising:

positioning a wellbore servicing apparatus within the wellbore proximate to a first subterranean formation zone, wherein the wellbore servicing apparatus comprises:

a housing defining an axial flowbore extending therethrough and comprising:

one or more high-pressure ports; and one or more high-volume ports, wherein the high-pressure ports are configured for a relatively high-pressure communication of fluid relative to the high-volume ports and wherein the high-volume ports are configured for a relatively high-volume communication of fluid relative to the high-pressure ports; and a mandrel slidably positioned within the housing, the mandrel defining a mandrel axial flowbore, the mandrel being movable;

from a first longitudinal position relative to the housing to a second longitudinal position relative to the housing, from the second longitudinal position to the first longitudinal position, and after returning to the first longitudinal position from the second longitudinal position, from the first longitudinal position to a third longitudinal position relative to the housing, wherein the mandrel further comprises a check valve within the mandrel axial flowbore, wherein the check valve is configured to restrict downward fluid communication via the mandrel flowbore and to permit upward fluid communication via the mandrel flowbore, and wherein the check valve comprises a obturating member trapped between an upper cage and a lower seat within the mandrel axial flowbore, wherein, when the mandrel is in the first longitudinal position, a route of fluid communication via the high-volume ports is obstructed, wherein, when the mandrel is in the second longitudinal position, a route of fluid communication via the one or more high-pressure ports is provided and the route of fluid communication via the high-volume ports is obstructed, and wherein, when the mandrel is in the third position, the route of fluid communication via the high-volume ports is provided;

configuring the wellbore servicing apparatus to deliver a jetting fluid while the mandrel is in the second longitudinal position;

communicating the jetting fluid via the wellbore servicing apparatus;

forming a fracture within the first subterranean formation zone by communicating a fluid via the wellbore servicing apparatus while the mandrel is in the third longitudinal position.

12. The method of claim 11, wherein communicating the jetting fluid via the wellbore servicing apparatus forms a perforation within a casing, a cement sheath, a wellbore wall, or combinations thereof.

13. The method of claim 11, wherein configuring the wellbore servicing apparatus to deliver the jetting fluid comprises making a first application of fluid pressure to an axial flowbore of the wellbore servicing apparatus.

14. The method of claim 13, wherein the first application of the pressure transitions a mandrel within the wellbore servicing apparatus from the first longitudinal position to the second longitudinal position.

15. The method of claim 14, wherein configuring the wellbore servicing apparatus to deliver a fluid at a rate and pressure sufficient to form and/or extend a fracture comprises:

releasing the first application of pressure;

making a second application of fluid pressure to the axial flowbore.

16. The method of claim 15, wherein releasing the first application of pressure transitions the mandrel from the second longitudinal position to the first longitudinal axial-position.

17. The method of claim 16, wherein the second application of pressure transitions the mandrel from the first longitudinal position to a third longitudinal position relative to the housing.

18. The method of claim 11, further comprising:

after forming a fracture within the first subterranean formation zone, positioning the wellbore servicing apparatus within the wellbore proximate to a second subterranean formation zone;

configuring the wellbore servicing apparatus to deliver a jetting fluid without communicating an obturating member to the wellbore servicing apparatus, without removing an obturating member from the wellbore servicing apparatus, or combinations thereof;

communicating the jetting fluid via the wellbore servicing apparatus;

forming a fracture within the second subterranean formation zone by communicating a fluid via the wellbore servicing apparatus.

19. The method of claim 11, wherein forming the fracture within the first subterranean formation zone by communicating a fluid via the wellbore servicing apparatus comprises communicating a proppant-laden fluid.

20. The method of claim 19, wherein forming the fracture within the first subterranean formation zone by communicating a fluid via the wellbore servicing apparatus comprises forming a composite fracturing fluid within the wellbore, the fracture, or combinations thereof.

21. The method of claim 11, wherein the housing further comprises a J-slot and the mandrel further comprises at least one lug, wherein the at least one lug is slidably positioned within the J-slot, wherein the J-slot comprises:

an upper profile comprising a plurality of upper notches; and a lower profile comprising a plurality of lower short notches and a plurality of lower long notches, wherein lower short notches and the lower long notches are alternatingly displaced within the lower profile.

22. The method of claim 11, further comprising a biasing member configured to bias the mandrel in the direction of the first longitudinal position.

* * * * *

UNITED STATES PATENT AND TRADEMARK OFFICE

CERTIFICATE OF CORRECTION

PATENT NO. : 8,931,557 B2
APPLICATION NO. : 13/544750
DATED : January 13, 2015
INVENTOR(S) : Patterson et al.

It is certified that error appears in the above-identified patent and that said Letters Patent is hereby corrected as shown below:

In the Claims

Column 25, claim 8, line 11, after “ports” insert -- is --.

Column 26, claim 16, line 34, delete “axial-”.

Signed and Sealed this
Nineteenth Day of May, 2015

Michelle K. Lee

Michelle K. Lee
*Director of the United States Patent and Trademark Office*